US006681757B1

(12) United States Patent
Rivero

(10) Patent No.: US 6,681,757 B1
(45) Date of Patent: Jan. 27, 2004

(54) PORTABLE OVEN

(76) Inventor: Mauricio Rivero, 3441 E. 8th Ave., Hialeah, FL (US) 33013

( * ) Notice: Subject to any disclaimer, the term of this patent is extended or adjusted under 35 U.S.C. 154(b) by 0 days.

(21) Appl. No.: 10/163,921

(22) Filed: Jun. 7, 2002

(51) Int. Cl.[7] ..... F24C 1/16
(52) U.S. Cl. ..... 126/9 R; 126/25 R
(58) Field of Search ..... 126/9 R, 9 B, 126/25 R, 9 A, 29, 38, 25 A, 152 R, 26

(56) References Cited

U.S. PATENT DOCUMENTS 1,923,131 A * 8/1933 Wilkinson ..... 126/9 R
3,109,420 A * 11/1963 Ott et al. ..... 126/9 R
3,146,773 A * 9/1964 Melzer ..... 126/9 R
3,384,066 A * 5/1968 Tufts ..... 126/9 R
4,211,206 A * 7/1980 Darbo ..... 126/9 R
4,508,096 A * 4/1985 Slattery ..... 126/9 R
6,467,474 B2 * 10/2002 Hermansen et al. ..... 126/25 R

* cited by examiner

*Primary Examiner*—James C. Yeung
(74) *Attorney, Agent, or Firm*—J. Sanchelima; A. Bordas

(57) ABSTRACT

A portable oven that is volumetrically efficient when in storage configuration and that can be readily assembled without requiring the use of tools. The portable oven is weatherproof and efficiently cooks the foodstuff placed therein. The portable oven includes two lateral sheets or walls members, a lid, two transversal sheet members, a base assembly, a pan assembly, two supporting members for the pan assembly, two grill assembly supporting members and a heat source. Smaller storage sheet or wall members replace the transversal sheet or wall members to form a storage configuration for all the oven components for their ready storage and transportation. The resulting storage configuration uses the same lateral sheet members used in the oven configuration.

8 Claims, 4 Drawing Sheets

PORTABLE OVEN

II. BACKGROUND OF THE INVENTION

1. Field of the Invention.

The present invention relates to a portable oven, and more particularly, to an oven that is volumetrically efficient when in storage and can be readily assembled without requiring the use of tools.

2. Description of the Related Art.

Many designs for ovens have been designed in the past. None of them, however, include a structure that permits the assembly and disassembly of an oven without requiring the use of any tools. Also, one of the advantages of the present invention is that it provides a cavity within the oven above the heat source that keeps a relatively constant high temperature that permits an efficient way of cooking food stuff, such as pigs, that require several hours. The cooking cavity is positioned above the heat source and with a cover maintains a relatively large space at a high and uniform temperature. The heat rises to the top and a layer of substantially uniform high temperature is created. The foodstuff is immersed in this layer at a sufficiently spaced apart relationship with respect to the heat source to prevent burning the food.

III. SUMMARY OF THE INVENTION

It is one of the main objects of the present invention to provide an oven that is portable and can be assembled without requiring the use of tools.

It is another object of this invention to provide an oven that is weatherproof and, when in storage and transportation, volumetrically efficient.

It is still another object of the present invention to provide an oven that efficiently and uniformly cooks the foodstuff placed therein without burning it.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
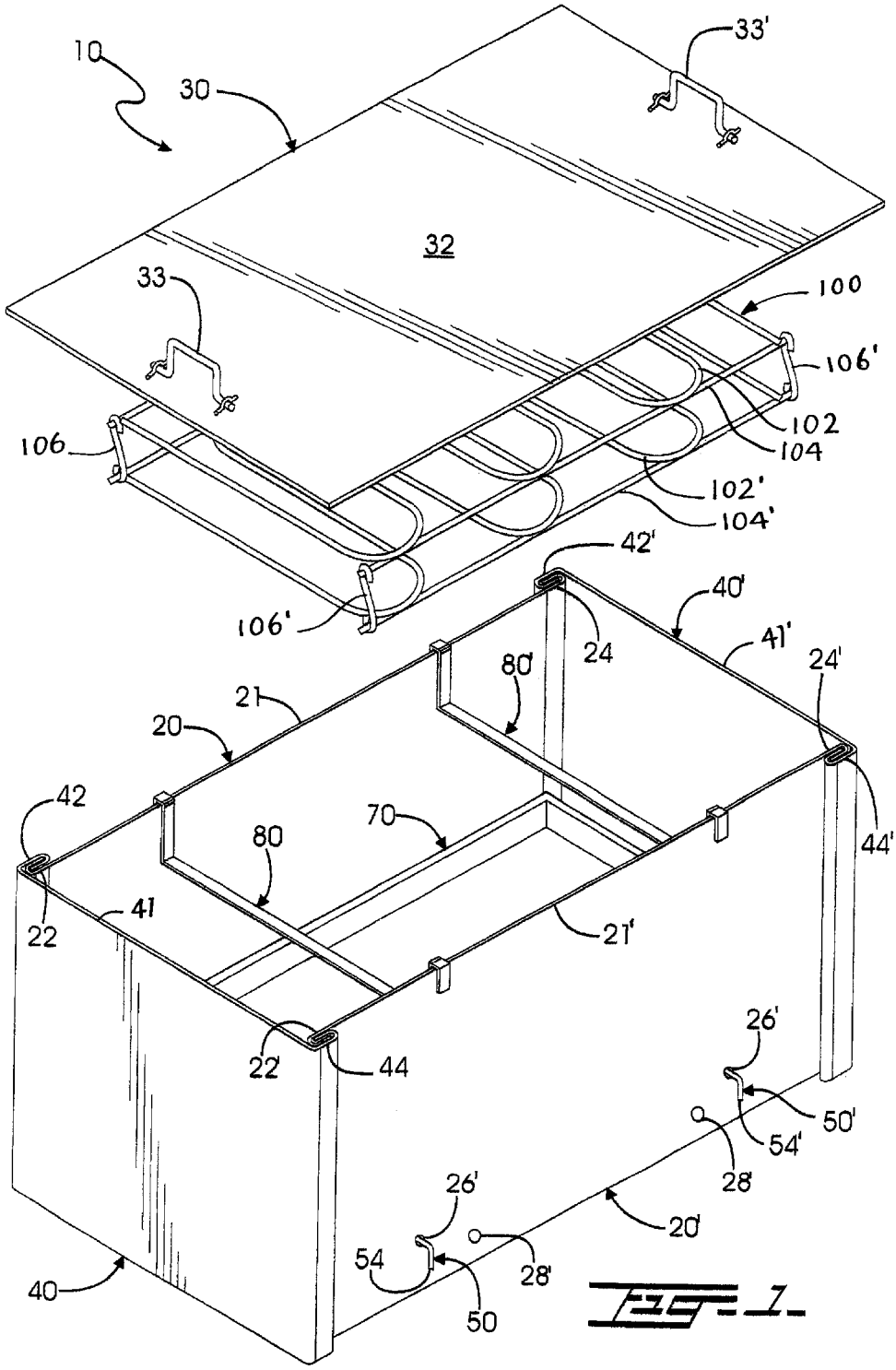
FIG. 1 represents an isometric view of the portable oven embodiments, object of the present application.

Referring now to the drawings, where the present invention is generally referred to with numeral 10, it can be observed that it basically includes, lateral wall members 20 and 20', lid 30, transversal wall members 40 and 40', elongated supporting assemblies 50 and 50', base assembly 60, pan assembly 70, elongated supporting members 80 and 80', storage assembly 90 and grill assembly 100. These components are made out of a heat resistant material, such as galvanized metal, steel or equivalent material.

As best seen in FIG. 1, when assembled, portable oven 10 has a substantially rectangular shape. Lid 30 is substantially a flat member 32 with a substantially rectangular shape that coincides with the cross sectional top dimensions of oven 10 to cover its upper opening. Lid 30 includes handler members 33 and 33' conveniently mounted thereon to facilitate its manipulation.

Figure 2:
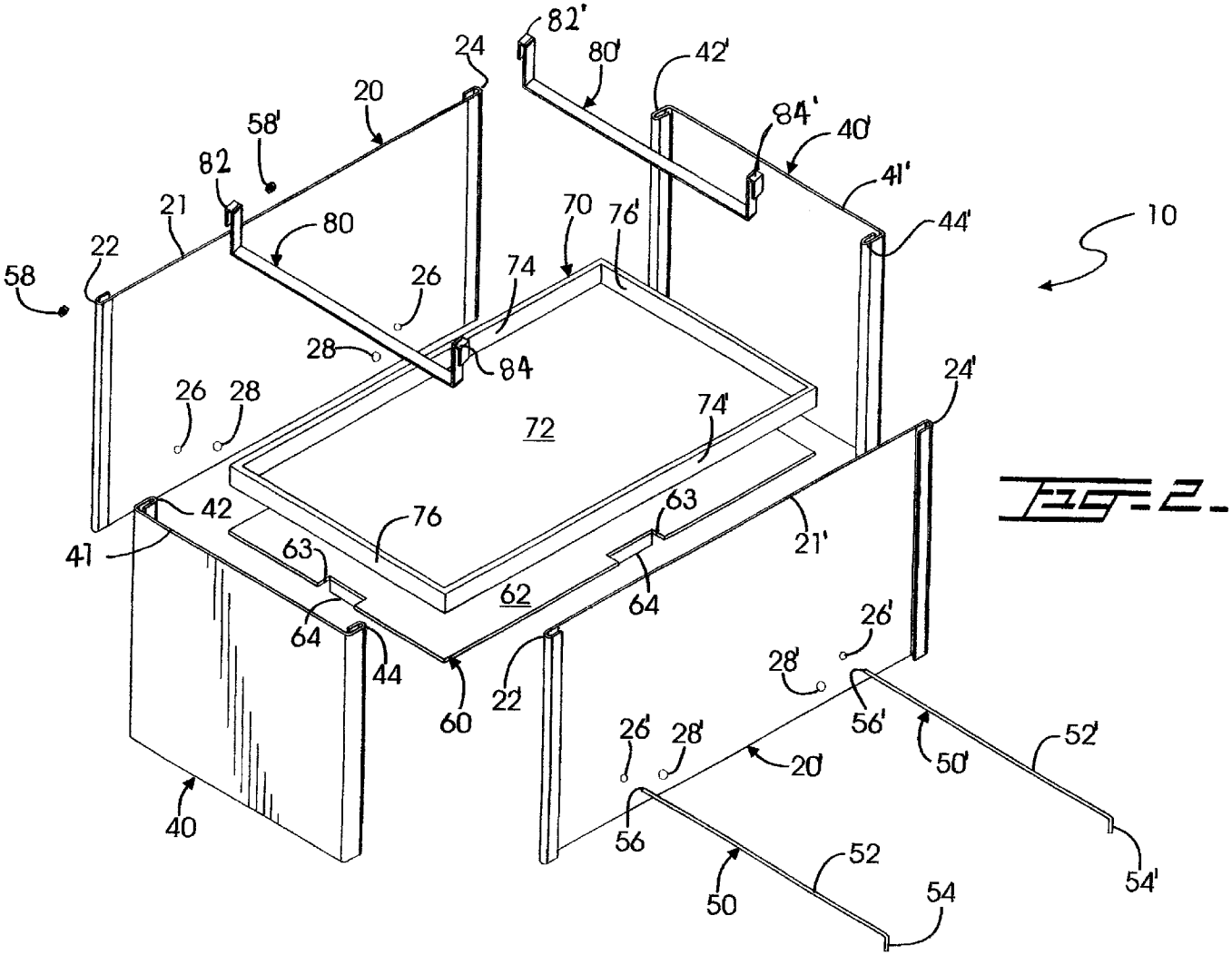
FIG. 2 illustrates an exploded view of the oven shown in the previous figure.

Lateral sheet members 20 and 20' have the same rectangular shape. As shown in FIG. 2, lateral wall member 20 (and 20') includes coextensive ends 22 and 24 (22' and 24' for 20'), openings 26 (and 26') and openings 28 (and 28'). Lateral wall member 20 (and 20') has upper edge 21 (and 21'). Upper edges 21 and 21' provides a surface to support lid 30.

Figure 3:
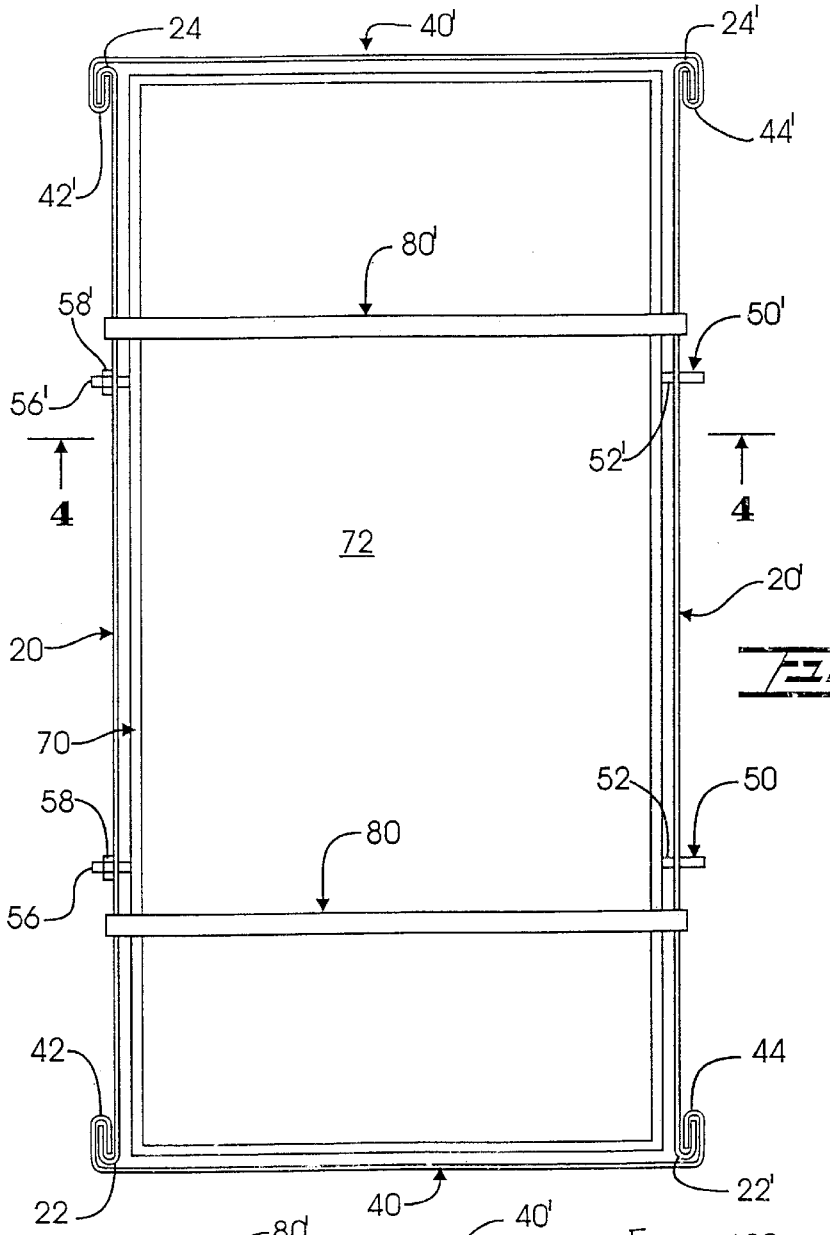
FIG. 3 shows a top view of the portable oven, shown in the previous figures.

Transversal wall member 40 includes coextensive inwardly folded ends 42 and 44. Transversal wall member 40' includes coextensive folded ends 42' and 44'. Ends 42; 42'; 44 and 44' have a cooperative folds to be slidably mounted to outwardly folded ends 22; 24; 22' and 24', respectively, as shown in FIG. 3. Transversal wall members 40 and 40' and lateral wall members 20 and 20' define a space therein when mounted to each other. Transversal wall members 40 and 40' have' lower ends folded outwardly for structural stability. Similarly, upper edges 41 and 41' cooperate with upper ends 25 and 25' to support lid 30.

Supporting assembly 50 (and 50') includes elongated supporting pin 52 (and 52') with an L-shape end 54 (and 54') and threaded end 56 (and 56'). Supporting pins 52 and 52' are removably mounted through lateral sheet members 20 and 20'. Pin 52 passes through openings 26 and 26'. L-shape end 54 coacts with lateral wall member 20 to prevent further travel in one direction. Threaded end 56 receives nut 58 preventing any movement in other direction. The same applies for elongated supporting pin 52', which passes through the other pair of openings 26' and 26. Pins 52 and 52' are made out of a heat resistant and rigid material such as steel, galvanized metal or equivalent.

Figure 4:
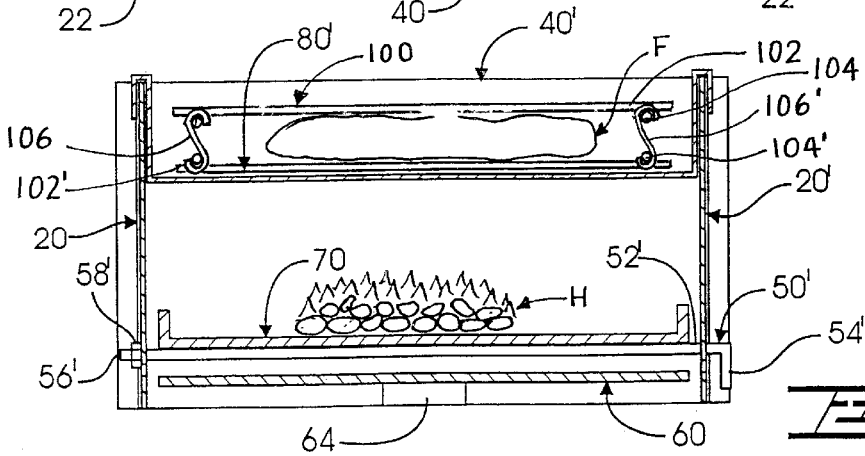
FIG. 4 illustrates a cross sectional view of a portion of the oven taken along line 4—4 in FIG. 3 also including the heat source and the food stuff.

Pan assembly 70 also has a cooperative rectangular shape with flat bottom 72 and peripheral upwardly extending walls 74; 74'; 76 and 76'. Pan assembly 70 supports the fuel for heat source H, such as charcoal, as shown in FIG. 4. Pan assembly 70 is removably mounted over supporting assemblies 50 and 50'.

Base assembly 60 includes protective base sheet 62. Cutouts 63 around the periphery of protective base sheet 62 are bent 90 degrees to form leg members 64. Leg members 64 keep sheet 62 at a spaced apart relationship with respect to the supporting surface. The objective being to protect the supporting surface from being exposed to excessive heat from source H. The separation of sheet 62 from the supporting surface provides a layer of air with its inherent thermal insulating properties.

Elongated supporting members 80 and 80' have ends 82 and 84 for member 80 and ends 82' and 84' for member 80', that engage with upper edges 21 and 21' of lateral sheet members 20 and 20'. Ends 82; 82'; 84' and 84' are removably mounted to upper edges 21 and 21' of lateral sheet members 20 and 20', as best seen in FIGS. 3 and 4. Supporting members 80 and 80' support grill assembly 100 at a predetermined distance from heat source H, as best seen in FIG. 1.

Grill assembly 100 includes two wide mesh members 102 and 102' that are formed with criss-crossed rigid members 104 and 104'. Foodstuff F, such as a pig, is sandwiched between mesh members 102 and 102' that are held together with twisted wires 106 and 106' or other equivalent means, as represented in FIG. 4.

Figure 5:
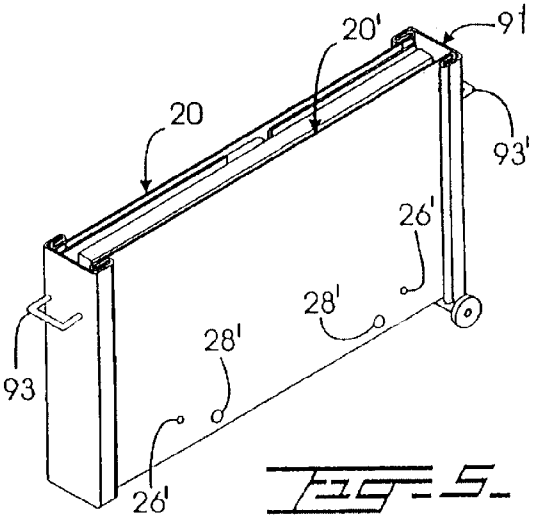
FIG. 5 is a representation of an isometric view of the storage housing assembly with the parts of the oven stored therein.
Figure 6:
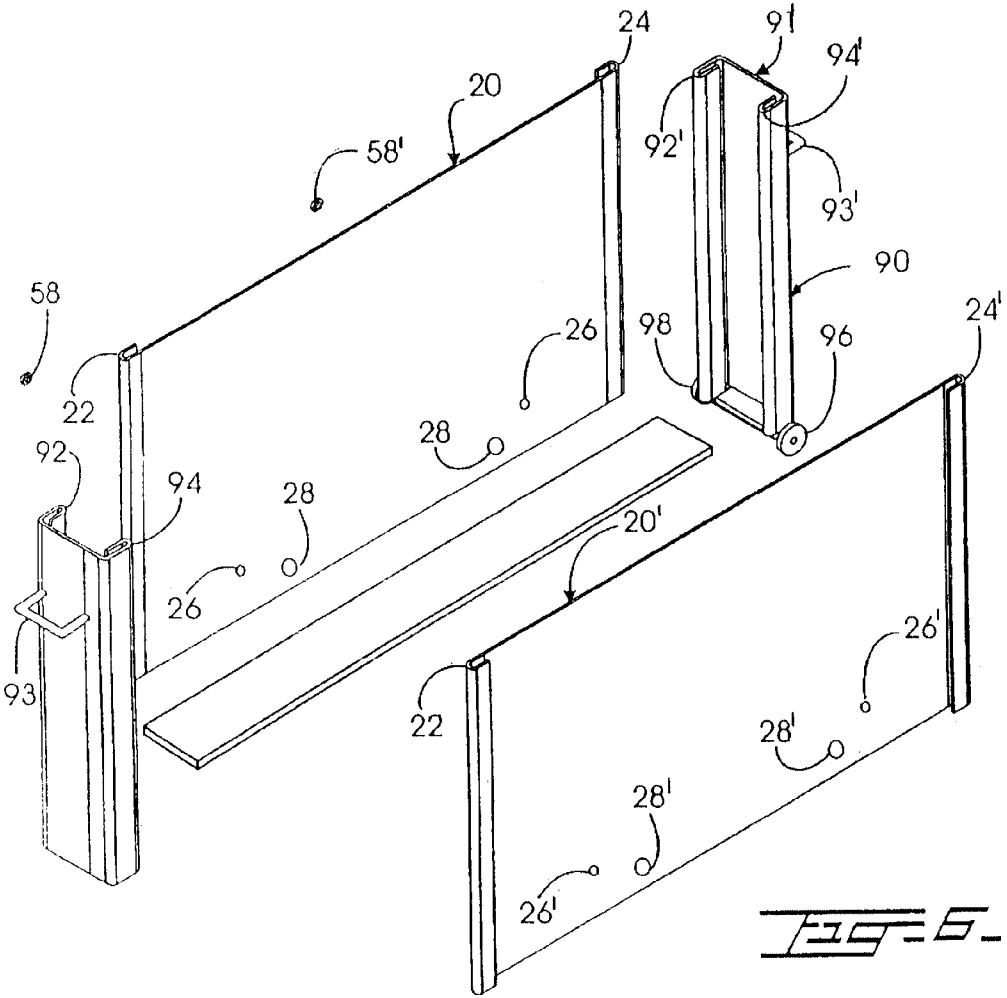
FIG. 6 illustrates an exploded view of the storage housing assembly.

Storage assembly 90 includes storage end wall members 91 and 91' that are shorter in width than transversal wall members 40 and 40'. Storage end wall member 91 includes coextensive inwardly folded ends 92 and 94. End wall member 91' includes coextensive inwardly folded ends 92' and 94'. Ends 92; 92'; 94 and 94' have cooperative shapes to be slidably mounted to coextensive ends 24; 22; 24' and 22', respectively, as shown in FIGS. 5 and 6. In this embodiment, lateral wall members 20 and 20' double as components of oven 10 and of a resulting storage assembly. End wall members 91 and 91' and lateral wall members 20 and 20' define a space therein for storage of the other parts of portable oven 10 when the latter is disassembled. Storage end wall member 91 (and 91') has handle member 93 (and 93') rigidly mounted to its outer wall to facilitate its manipulation. Storage end wall members 91 and 91' also have upper and lower ends folded outwardly for added structural support.

Wheel assembly 96, as shown in FIGS. 5 and 6, is added to facilitate the transportation of the oven parts when in the storage configuration. Wheel assembly 96 includes wheeled pin 97, wheel 98, and cylindrical spacer member 99. Wheeled pin 97 passes through cylindrical spacer member 99. Once wheeled pin 97 is passed through, wheel 98 is mounted and the free end of wheeled pin 97 is capped with nut 58. The purpose of wheel assembly 96 is to facilitate the transportation of the oven over relatively short distances. Storage assembly 90 provides a supporting structure for the parts of the oven that are being stored.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An oven, comprising:

A) first and second wall members having substantially the same rectangular shape and each having first and second coextensive ends and first upper and lower edges, said lower edge resting on a horizontal surface;

B) third and fourth sheet members each having substantially the same rectangular shape and third and fourth ends and second upper and lower edges;

C) means for removably mounting said first and second ends to said third and fourth ends, respectively, thereby defining a space;

D) first and second supporting means removably mounted to said first and second wall members at a predetermined distance from said lower edges;

E) a pan assembly for supporting a heat source, said pan assembly being removably mounted on said first and second supporting means so that said heat source is kept at a substantially horizontal position at a predetermined distance from the plane defined by said horizontal surface;

F) third and fourth supporting means removably mounted to said first and second upper edges; and G) a grill assembly for supporting foodstuff, said grill assembly being removably mounted to said third and fourth supporting means.

2. The oven set forth in claim 1 further including:

H) a protective base assembly including at least four leg members for keeping said base assembly at a spaced apart relationship with respect to said horizontal surface and below said first and second supporting means.

3. The oven set forth in claim 2 further including:

I) fifth and sixth wall members having substantially the same rectangular shape, and each having fifth and sixth coextensive ends and third upper and lower ends;

J) means for removably mounting said firth and sixth coextensive ends to said first and second coextensive ends thereby defining a storage space; and K) fifth and sixth supporting means removably mounted between said first and second sheet members at a predetermined distance from said lower edges so that said third and fourth sheet members, first, seccind, third and fourth supporting means, protective base and pan assemblies are supported and housed within said storage space.

4. The oven set forth in claim 3 further including wheel means to facilitate the transportation of said oven.

5. The oven set forth in claim 4 wherein said wheel means includes at least one wheel member mounted to said fifth or sixth supporting means.

6. The oven set forth in claim 5 wherein said means for removably mounting said first and second ends to said third and fourth ends, respectively, include cooperating folded coextensive ends that are slidably mounted within each other.

7. The oven set forth in claim 6 wherein said means for removably mounting said fifth and sixth coextensive ends to said first and second coextensive ends, respectively, include cooperating coextensive ends that are slidably mounted within each other.

8. The oven set forth in claim 1, further including:

L) storage means including fifth, sixth seventh and eighth sheet members having each a substantially rectangular shape with the same height said fifth and sixth wall members being similar to each other and said seventh and eighth wall members being similar to each other with a larger width that said fifth and sixth wall members, and being removably mounted to each other to form a storage space; and M) fifth and sixth supporting means removably mounted between said first and second wall members at a predetermined distance from said lower edges so that said third and fourth wall members, first, second, third and fourth supporting means, protective base and pan assemblies are supported within said storage space.

* * * * *